US005253367A

United States Patent [19]

Lappley

[11] Patent Number: 5,253,367

[45] Date of Patent: Oct. 19, 1993

[54] GOLF GLOVE

[76] Inventor: Gerald H. Lappley, 1244 El Camino Dr., NW., Grand Rapids, Mich. 49504-2451

[21] Appl. No.: 897,944

[22] Filed: Jun. 5, 1992

[51] Int. Cl.[5] ..... A41D 19/00; A63B 71/14

[52] U.S. Cl. ..... 2/161.3; 273/166

[58] Field of Search ..... 273/166, 189 R, 54 B; 2/159, 160, 161 R, 161 A, 165, DIG. 6

[56] References Cited

U.S. PATENT DOCUMENTS

| | | | |
|---|---|---|---|
| 2,258,999 | 10/1941 | Nunn | 273/166 X |
| 2,270,882 | 1/1942 | Link | 2/159 |
| 2,710,970 | 6/1955 | Kennedy | 2/159 |
| 3,065,472 | 11/1962 | Linnell | 2/161 A |
| 3,583,704 | 6/1971 | Callanan | 273/54 B |
| 3,606,614 | 9/1971 | Dimitroff | 2/159 |
| 3,863,271 | 2/1975 | Moroney | 273/166 X |
| 4,000,903 | 1/1977 | Swanson | 273/166 |
| 4,071,913 | 2/1978 | Rector | 2/161 A X |
| 4,326,706 | 4/1982 | Guthrie et al. | 2/160 X |
| 4,329,741 | 5/1982 | Bach | 2/161 A |

FOREIGN PATENT DOCUMENTS

| | | | |
|---|---|---|---|
| 3429739 | 3/1985 | Fed. Rep. of Germany | 2/159 |
| 0253177 | 1/1988 | Fed. Rep. of Germany | 2/159 |
| 2232338 | 12/1990 | United Kingdom | 2/161 A |

*Primary Examiner*—V. Millin
*Assistant Examiner*—Sebastiano Passaniti
*Attorney, Agent, or Firm*—Waters & Morse

[57] ABSTRACT

A golf glove that encourages a proper grip on the upper hand of a golf grip comprises a conventional golf glove having an elongated padded hump positioned adjacent the third and fourth fingers of the golf glove and aligned parallel with the bases of the third and fourth fingers of the glove. The hump is formed of leather or other flexible sheet material into a pocket, and the pocket is filled with cotton batten or other non-woven compressible fibrous material. The hump non-elastically conforms with the shape of the grip and forms an enlarged portion that urges the grip against the knuckle portion of the third and fourth fingers of the hand and enhances the gripping action of the third and fourth fingers. The hump does not extend over the heel portion of the hand and does not impair significantly the feel of the glove club.

4 Claims, 1 Drawing Sheet

GOLF GLOVE

BACKGROUND OF THE INVENTION

This invention relates to golf gloves and more particularly to an improved golf glove having an elongated padded hump on the palm opposite the third and fourth fingers of the glove that urges the distal end of a golf club to nest adjacent the knuckles of the third and fourth fingers of the upper hand and enhances the gripping force of the third and fourth fingers of the upper hand without producing uncomfortable pressure on the hand of the golfer.

Various attempts have been made to modify a conventional golf glove to improve a golfer's grip on the club. Several types of golf gloves have been developed wherein one or more ridges are formed on the finger or palm portion of the golf glove in order to urge the golf club grip into proper alignment in the hand. Conventional wisdom has it that the golf club should be gripped primarily by the third and fourth fingers of the upper hand and between the thumb and first finger of the lower hand, with the distal end of the golf club being held adjacent the knuckles of the third and fourth fingers of the upper hand and not allowed to pivot into the palm of the upper hand.

An object of the present invention is to provide an improved golf glove that properly positions the golf club in the upper hand and enhances the golfer's grip on the distal end of a golf club, while retaining the feel of the golf club and producing a comfortable grip that conforms nonelastically to the shape of the golf glove grip.

SUMMARY OF THE INVENTION

A golf glove for enhancing the grip of a golfer's upper hand on the distal end of a golf club grip comprises a glove portion with fingers that at least partially cover the golfer's fingers and a palm portion that covers the palm of the golfer's hand. An elongated hump on the palm portion of the glove guides the golf club into proper position in the golfer's hand and enhances the golfer's grip on the golf club. The hump extends inwardly from an outer side of the glove toward an inner side of the glove but does not extend to the knuckle of the first finger. The hump is substantially parallel to a line extending through the intersection of the bases of the third and forth fingers of the glove but is spaced away from the bases of the fingers by a distance that causes the hump to partly wrap around the golf club grip and urge the grip toward the knuckles of the third and fourth fingers when a gripping pressure is applied to the golf club. The hump comprises a pocket of flexible sheet material on the palm of the glove, which is filled with a compressible filler material preferably formed of a non-woven fibrous material such as cotton batting or the like. The hump is generally rectangular in shape and has a width sufficiently narrow that the outer end of the hump does not extend over the heel of the hand, which would impair the feel that the golfer would be able to achieve with a glove and would limit the ability of the hand to be wrapped around the golf glove grip.

The hump, being filled with cotton batting or the like, is non-elastically compressible and deformable such that gripping a golf club with the glove causes the hump to conform with the shape of the grip, with the padding forming a bulge on the wrist side of the grip that urges the grip toward the knuckles of the hand and it restrains the grip from slipping toward the heel of the glove. The non-elastic nature of the padding causes the hump to take on the shape of the golf grip and thus causes the glove to fit the golfers' golf clubs after it has been worn a few times. This makes the golf glove more comfortable and the bulge less noticeable.

The hump extends across the palm of the glove opposite the third and fourth fingers of the hand. This enhances the firmness of the grip of the third and fourth fingers, which is desirable. The bulge should not extend all the way to the knuckle of the first finger, and preferably it does not extend over the knuckle of the second finger, such that the enhancement affect of the bulge is realized by the main gripping fingers, which are the third and fourth fingers.

In order to achieve the desired comfort and grip enhancement with the present invention, it is preferred that the hump be about one-half ($\frac{1}{2}$) inch to about one and one-quarter ($1\frac{1}{4}$) inches wide and two (2) inches to tow and one-half ($2\frac{1}{2}$) inches long and generally rectangular in shape, with the padding being of a thickness of about one-eighth ($\frac{1}{8}$) to about five-eighths ($\frac{5}{8}$) inches thick. For a medium sized men's glove, the hump desirably is about seven-eighths ($\frac{7}{8}$) inches to one (1) inch wide, two and one-half ($2\frac{1}{2}$) inches long, e and about one-quarter ($\frac{1}{4}$) to one-half ($\frac{1}{2}$) inch thick.

These and other features of the present invention are described below and shown in the appended drawings.

DETAILED DESCRIPTION OF THE PREFERRED EMBODIMENT

Figure 1:
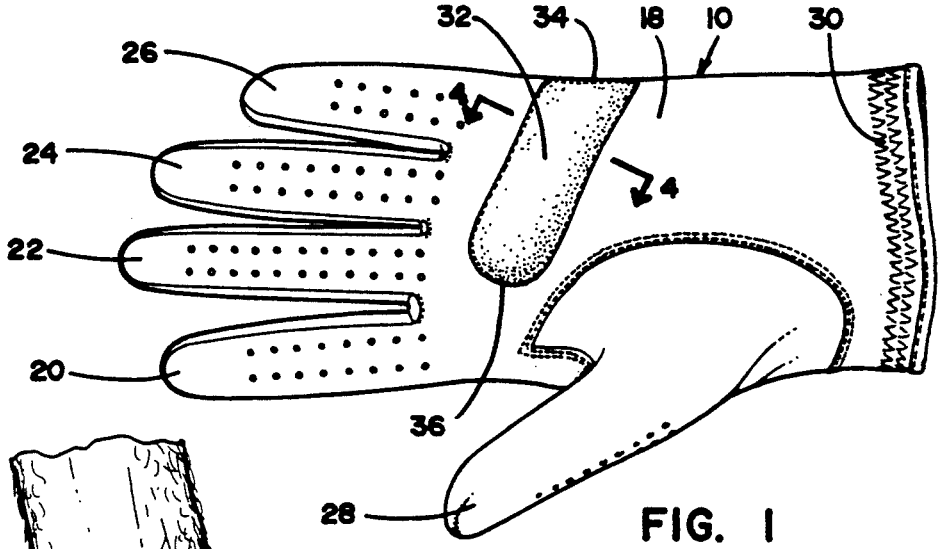
FIG. 1 is a plan view of the palm portion of the golf glove of the present invention.
Figure 2:
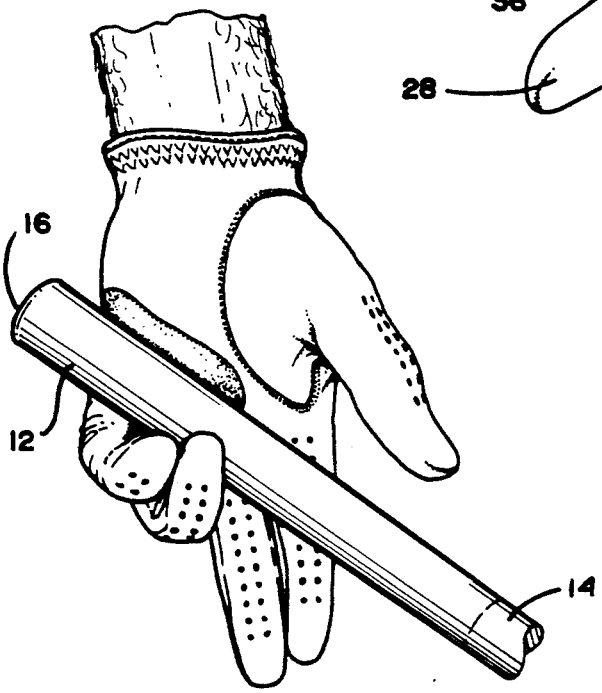
FIG. 2 is a perspective view showing a golfer's upper hand wearing the glove of the present invention and grasping the grip portion of a golf club before closing the grip.
Figure 3:
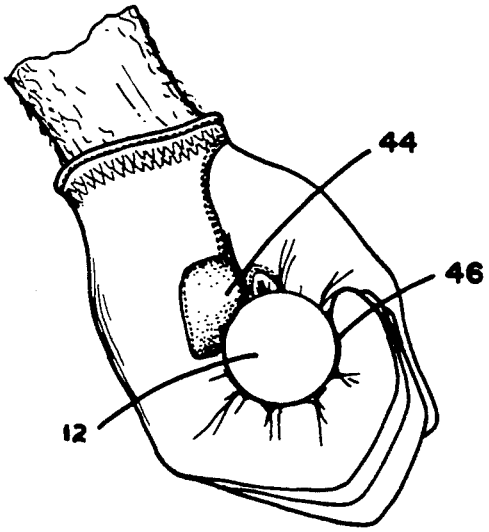
FIG. 3 is a perspective view taken from the end of a golf club grip showing the position of the golf club when gripped with the golf glove of the present invention.
Figure 4:
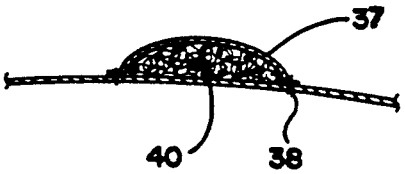
FIG. 4 is a sectional view taken along lines 4—4 of FIG. 1.

Referring to the drawings, a golf glove 10 constructed in accordance with the present invention is shown in FIGS. 2 and 3 gripped about a grip 12 of a golf club 14. For illustrative purposes a right-handed golfer is shown, with the golf glove being worn on the left or upper hand of the golfer and with this hand being positioned adjacent the distal end 16 of the golf club. It should be understood that the invention also could be employed for a left-handed golfer, wherein the golf glove would be worn on the right-hand of the golfer.

Golf glove 10 includes a glove portion that is substantially conventional and includes a palm portion 18, first, second, third and fourth fingers 20, 22, 24, and 26, respectively, a thumb 28 and a wrist portion 30 that may be tightened around the wrist of the golfer by elastic, velcro, a snap, or other fasteners An elongated hump 32 is formed on the palm of the glove opposite the third and fourth fingers thereof. Hump 32 is rectangular in shape and extends from an outer side 34 of the glove to an inner end 36, which preferably is positioned at but not extending over the second finger of the glove. End 36 should not extend over the knuckle of the first finger of the glove and desirably does not affect the grip of the second finger of the glove. Hump 32 is formed of a flexible sheet material 37 which is stitched to the palm of the glove by an appropriate thread 38 so as to form a pocket on the palm of the glove. The hump is filled with a padding material 40. Desirably, the pocket is formed by stitching the sheet material (which is preferably a soft glove leather of the type used for the golf club itself) around three sides of the pocket, leaving the end adjacent the outer side of the glove open. Thereafter, the pocket is stuffed with the padding material and then sewn at the edge of the glove.

The position and dimensions of the hump and the padding and thickness of the hump are very important features of the present invention. It is important that the hump not constitute a thin, hard ridge. A thin, hard ridge does little to enhance golf club alignment, and it does not provide a bulge that urges the golf club grip to its proper position. Moreover, a ridge tends to be pressed into the palm of the golfer's hand and is uncomfortable. Further, a hard ridge ultimately wears a hole in the golf glove faster than would ordinarily occur.

On the other hand, it is important that the bulge be of moderate proportions, so that the feel of the golf club is maintained while the improvements are being achieved. It is important that the padding not extend over the heel of the hand or glove. The feel of the fingertips on the glove is adversely affected when thick padding covers the heel of the glove.

In order to provide sufficient room for a golf grip, the edge of the hump adjacent the fingers should be at least one-half (½) inch away from the bases of the third and fourth fingers and preferably about three-quarters (¾) of an inch away from the fingers for a medium sized men's glove. This enables the grip to be used with an oversized or arthritic grip, which some older golfers prefer. A golf glove having parallel ridges which the golf grip is intended to fit between usually does not accommodate a larger grip and has restrictions about grip size that limit the effectiveness of the product.

The hump of the present invention is about one-half (½) to one and one-quarter (1¼) inches wide and about two (2) to two and one-half (2½) inches long. The pad does not cover the fingers or the knuckles of the hand when the glove is wrapped around the golf club grip, nor does it prevent the fingers of the golf club grip from touching an unpadded palm portion of the glove at the heel of the glove. Rather, the hump is wedged against the golf club grip at a critical position just above the position where the golf club grip nests against the fingers and knuckles of the third and fourth fingers of the hand. Desirably, the glove is about seven-eighths (⅞) inches to one (1) inch wide for a normal sized glove used for a man. This enables the pressure on the padding to be spread comfortably over a large area of the hand, while leaving much of the hand unpadded so that a proper feel on the glove can be achieved.

The filling material used in the pocket is an important feature of the invention. Resilient materials with substantial elasticity, such as foam or solid rubber or other synthetic or natural elastomeric materials, are not desirable. A proper degree of compressibility of such materials is hard to achieve without creating a hard and uncomfortable feeling on the hand or inadequate club retaining force on the other hand. Moreover, the glove never feels comfortable because the materials resiliently return to their original volume and shape each time the glove is used. Hard materials, such as rods or cords, are uncomfortable and do not spread the compressive force out in a desirable manner so as to enhance the grip and comfort.

The preferred material of the present invention is a simple cotton batting type of material, which is a compressible natural fiber. Comparable non-woven synthetic fiber also can be used. Other materials having similar compressibility characteristics also would be satisfactory.

Desirably, the pocket is formed and filled so that it is snugly filled with cotton batting to a height of about one-eighth (⅛) to about five-eighths (⅝) inches, and preferably about one-quarter (¼) inch to one-half (½) inch high. The height of about one quarter (¼) inch is especially preferred. The pocket is filled snugly and then sewn closed. There is enough elasticity in the pocket and compressibility of the material such that as the glove is used to grip a golf club, the cotton packs down and conforms with the shape of the golf club grip and deforms so that the padding fits comfortably around the golf club grip, urging the golf club grip toward a position against the fingers and knuckles of the fourth and fifth fingers of the hand. The padding in the hump bulges outwardly above the grip (as shown in FIG. 3) forming a bulge 44 that is spaced more than one hundred eighty degrees (180°) away from the gripping surfaces 46 of the fingertips of the hand. The bulge thus forces the grip downwardly as shown in FIG. 3 into proper position in the hand. The bulge resists the movement of the golf club grip upwardly into a position adjacent the heel or middle of the palm of the hand.

As shown in FIG. 3, the hump of the present invention conforms with the grip of the club so that the pressure of the club on the hump is distributed comfortably over a large area of the hand and does not impede the feel of the grip. The bulge enhances the gripping action of the third and fourth fingers of the hand, which is the desirable result, without affecting the gripping of the first and second fingers, thus placing emphasis on the third and fourth fingers of the hand.

It should be understood that the foregoing is merely representative of the preferred embodiment of the present invention and that various modifications may be made in the preferred embodiment without departing from the spirit and scope of the present invention, which is defined in the appended claims.

I claim:

1. A golf glove that enhances the grip of a golfer's upper hand on the distal end of a golf club grip comprising:

a glove portion including fingers that at least partially cover the golfer's fingers and a palm portion that covers the palm of the golfer's hand; and an elongated padded hump on the palm portion of the glove, the hump extending inwardly from an outer end at an outer side of the glove toward an inner end at an inner side of the glove but not extending to the knuckle of the first finger of the glove, the hump extending substantially parallel to a line extending through the intersection of the bases of the third and fourth fingers of the glove but being spaced away from said line by a distance such that when a golf club is properly gripped by a golfer's third and fourth fingers, the hump fits at least partially over the golf club and urges the golf club grip inwardly toward the knuckles of the third and fourth fingers, the hump comprising a pocket of flexible sheet material on the palm of the glove, with the pocket being filled with a compressible filler comprising non-woven fibrous materials, the hump having substantially parallel longitudinal sides that extend the length of the hump and having a width sufficiently narrow that the outer end of the hump does not extend over the heel of the hand, the hump being non-elastically compressible to a substantial extent and deformable such that gripping the golf club grip with the glove causes the hump to non-elastically conform with the shape of the grip, with the padding being urged toward the wrist of the glove so that it tends to wrap around the grip with an enlarged portion on the wrist side of the grip that guides the grip toward the knuckles of the hand and restrains the grip from slipping toward the heel of the glove, the hump being shaped such that it serves to enhance the grip of the hand against the golf grip, the hump being positioned opposite the third and fourth fingers of the glove such that the grip is selectively enhanced for the third and fourth fingers and not the first finger, the overall effect being that the glove urges the grip to remain adjacent the knuckles of the hand and enhances the gripping force of the third and fourth fingers, thereby urging a proper grip on the golf grip.

2. A golf glove according to claim 1, wherein the hump is filled with a natural or synthetic fiber having compressibility characteristics comparable to cotton batting, such that the hump feels soft on the hand and non-elastically conforms to the shape of the glove user's golf club grip, causing the glove to eventually acquire a substantially formed shape that fits comfortably on the club grip.

3. A golf glove according to claim 1, wherein the hump is about one-half ($\frac{1}{2}$) inch to about one and one-quarter ($1\frac{1}{4}$) inches wide and padded to a thickness of about one-eighth ($\frac{1}{8}$) to about five-eighths ($\frac{5}{8}$) inches, such that the hump forms an enlarged portion that wraps sufficiently around the grip to urge the grip toward the knuckles as gripping pressure is exerted, with the hump width spreading the gripping pressure over a sufficiently larger portion of the hand that the pressure under the hump is not uncomfortable, the heel of the palm not being covered by the bulge such that the glove does not impede the hand from wrapping around the grip.

4. A golf glove according to claim 3, wherein the hump is about seven-eighths ($\frac{7}{8}$) inches to one inch wide and about one-quarter ($\frac{1}{4}$) inch thick and extends inwardly from the outer side of the glove to a point where the hump enhances the grip of the third and fourth fingers but does not enhance the grip of the first finer.

* * * * *